United States Patent [19]

Dudek

[11] Patent Number: 4,627,961

[45] Date of Patent: Dec. 9, 1986

[54] CALCIUM-ALUMINUM BRIQUETTES

[75] Inventor: David M. Dudek, Great Barrington, Mass.

[73] Assignee: Pfizer Inc., New York, N.Y.

[21] Appl. No.: 772,293

[22] Filed: Sep. 4, 1985

[51] Int. Cl.[4] ..... C22C 11/02

[52] U.S. Cl. ..... 420/564

[58] Field of Search ..... 420/564

[56] References Cited

U.S. PATENT DOCUMENTS 4,342,590 8/1982 Luyckx ..... 75/53

4,439,398 3/1984 Prengaman ..... 420/564

4,450,136 5/1984 Dudek ..... 420/590

*Primary Examiner*—Peter D. Rosenberg

*Attorney, Agent, or Firm*—Charles J. Knuth; Peter C. Richardson; Gezina Holtrust

[57] ABSTRACT

Calcium-aluminum briquettes comprising a mechanically compressed mixture of 65 to 80% by weight of calcium granules and 20 to 35% by weight of aluminum granules are added to molten lead to obtain a lead alloy containing about 0.1% by weight of calcium and 0.03% by weight of aluminum.

3 Claims, No Drawings

CALCIUM-ALUMINUM BRIQUETTES

BACKGROUND OF THE INVENTION

The invention relates to calcium-aluminum briquettes comprising a mechanically compressed mixture of calcium and aluminum granules and a method for the manufacture of a lead alloy by mixing said briquettes with lead.

Calcium and aluminum have been incorporated in lead to form lead alloys of use in the manufacture of grids for maintenance-free auto batteries.

Aluminum has a high melting point of about 1220° F. (about 660° C.) requiring heating of lead to at least about 1200° F. (650° C.) to form the aluminum-containing lead alloy. These high temperatures may be avoided by first combining calcium and aluminum into an alloy which melts at or above 1000° F., as described in U.S. Pat. No. 4,439,398. Further reduction of these alloying temperatures may be attained as described below.

SUMMARY OF THE INVENTION

According to the invention, there is provided calcium-aluminum briquettes comprising a mechanically compressed mixture of 65 to 80% by weight of calcium granules and 20 to 35% by weight of aluminum granules.

In a specific embodiment of the invention, the calcium-aluminum briquettes comprise 70 to 76% by weight of calcium granules and 30 to 24% by weight of aluminum granules and, preferably, 73% by weight of calcium and 27% by weight of aluminum.

The invention also provides a method for the manufacture of a lead-calcium-aluminum alloy by adding calcium-aluminum briquettes to molten lead and mixing said briquettes with said molten lead at about 850° to 1000° F. (454° to 538° C.).

DETAILED DESCRIPTION OF THE INVENTION

For the purpose of the present specification and claims, a briquette is defined as a small brick of any shape including spheres, pellets, rods, broken strips and broken sheets.

The calcium-aluminum briquettes described above may be prepared by mechanical compression of a mixture of calcium granules and aluminum granules. Mechanical compression of metal particles is a known procedure particularly widely used in the recycling of iron. Any method for mechanically compressing metal particles may be used, although care must be taken to exclude oxygen and moisture in view of the reactivity of calcium with oxygen and water. The briquettes are packaged in sealed containers such as steel drums to avoid contact with oxygen, moisture in the air, and water.

The size of the calcium and aluminum granules is not critical and generally the size of the length, breadth and height, or the diameter ranges from about 100 mesh (U.S. Standard Sieve Size) to 0.25 inch.

The calcium-aluminum briquettes are easier to prepare than the corresponding alloys in view of the simpler manufacture by compression rather than alloying.

The calcium-aluminum briquettes are added to molten lead to manufacture lead-calcium-aluminum alloys. Although applicant does not wish to be bound by any particular theory, it is postulated that the calcium in the above-mentioned prior art Ca/Al alloy is relatively passive so that the lead must be at the melting temperature of the calcium-aluminum alloy to form a lead-calcium-aluminum alloy. The calcium in the calcium-aluminum briquettes is not passive and reacts with the lead at temperatures lower than the melting point of the briquettes. When the briquettes are added to the molten lead at about 850° F. (454° C.), the calcium in the briquettes reacts with the lead under exothermal conditions leading to localized high temperatures. These high temperatures are high enough to melt the aluminum present in the briquettes.

In the manufacture of the lead-calcium-aluminum alloy, it is important to attain complete melting of the briquettes and homogeneous mixing thereof with the molten lead. In the practice of the invention, generally, heating of the molten lead to about 850° F. is followed by gradual addition of the briquettes to attain complete mixing. Relatively low temperatures of about 850° to 1000° F. (538° C.) are generally used in view of the violent reaction between the lead and the calcium in the briquettes. Higher temperatures may be used on carefully controlling the rate of Ca/Al-briquette addition. After complete addition of the briquettes, the alloy mixture may be slowly heated to about 950° F. (510° C.).

One method to attain complete and homogeneous mixing of the briquettes and the lead makes use of the "cage" method. According to this method, the briquettes are lowered into molten lead at about 850° F. or more in a steel cage. The cage is required to hold down the briquettes in the lead since the briquettes are lighter in weight than the lead. The calcium in the briquettes is allowed to react with the lead and gradual mixing takes place on further supply of external heat to raise the temperature of the melt to about 950° F.

In another method, the molten lead is stirred at very high speed so that a vortex is created forcing the briquettes to the bottom of the available lead and causing the briquettes to dissipate into the lead before any of the briquette material surfaces. This method is known as the stirred funnel technique.

Other methods for the complete and homogeneous mixing of the briquettes in the molten lead will readily be apparent to the skilled person.

In general, the size of the briquettes is not critical, and may range for instance, from a size of about 1 inch by $1\frac{5}{8}$ inch by $\frac{5}{8}$ inch to twice or three times that size. The suitable size of a briquette depends on the mixing method used. For instance, in the stirred funnel method, the briquette size depends on the size of the vessel and the rate of stirring. The larger the vessel, the larger the briquettes which may be used, and the higher the rate of stirring, the larger the briquettes which may be used.

After the briquettes are completely and homogeneously mixed with the molten lead, the mixture is poured into ingots to obtain a lead alloy containing calcium and aluminum. Preferably, the lead alloy contains about 0.1% by weight of calcium and 0.03% by weight of aluminum.

The briquettes may contain tin for addition to lead to obtain a tin-containing lead alloy.

The calcium-aluminum briquettes may be added to metals other than lead such as lithium, tin, or lead and tin, to form known alloys.

The following Examples illustrate the invention and are not to be construed as limiting the invention.

EXAMPLE 1

Metallic particulate calcium (83 kg) was mixed with 31 kg of metallic particulate aluminum. The particle size of the calcium was about minus 0.25 inch and the particle size of the aluminum was about minus 0.25 inch. The mixing was accomplished by rotation of a 55 gallon (208 ) drum containing the metal particles for 30 minutes on a drum rotator. The premixed calcium and aluminum was dumped into a hopper located directly above a hydraulic briquette press and flowed by gravity into the briquette press. The press had 12 inch (30.5 cm) diameter rolls. Pillow shaped briquettes, 1 inch (2.5 cm) by 1⅝ inch (4.1 cm) by ⅝ inch (1.6 cm), were formed at a rate of 535 lbs (243.2 kg) per hour using a roll speed of 5.25 RPM and a roll separating force of 28 ton (25.5 metric ton).

EXAMPLE 2

To 73 metric tons of molten lead at 550° to 600° C. was added 91 kg of calcium-aluminum briquettes having a calcium/aluminum ratio of 73/27 and prepared as described in Example 1. The briquettes were added into a vortex in the molten lead and the resulting mixture was stirred for 20 minutes to distribute the calcium and aluminum evenly in the lead. The molten alloy was then poured into ingots. The alloy contained 0.035% by weight aluminum and 0.1% by weight calcium.

EXAMPLE 3

To 55 metric tons of molten lead at 450° to 500° C. was added 68 kg of calcium-aluminum briquettes having a calcium/aluminum ratio of 73/27 and prepared as described in Example 1. The briquettes were added by placing them in a steel cage and lowering the cage down into the molten lead. The resulting melt was stirred to distribute the calcium and aluminum evenly in the lead as the melt was heated to 550° to 600° C. On complete distribution, the melt was poured into ingots.

EXAMPLE 4

Metallic particulate tin (100 kg) is mixed and blended with 15 kg of metallic particulate calcium and 5.5 kg of metallic particulate aluminum as outlined in Example 1.

EXAMPLE 5

To 1000 kg of molten lead at 550° to 600° C. is added with stirring 10 kg of the tin/calcium/aluminum briquettes of Example 4. The resulting melt is stirred an additional 15 minutes and cast on a water cooled grid-casting machine having an enclosed delivery system of the type conventionally used for casting 6% antimony/-lead grids.

I claim:

1. A calcium-aluminum briquette which comprises a mechanically compressed mixture of 65 to 80% by weight of calcium granules and 20 to 35% by weight of aluminum granules.

2. A calcium-aluminum briquette according to claim 1 wherein said mixture comprises 70 to 76% by weight of calcium granules and 30 to 24% by weight of aluminum granules.

3. A calcium-aluminum briquette according to claim 1 wherein said mixture comprises 73% by weight of calcium granules and 27% by weight of aluminum granules.

* * * * *